US011839904B2

(12) United States Patent
Haremaki et al.

(10) Patent No.: US 11,839,904 B2
(45) Date of Patent: Dec. 12, 2023

(54) CLEANING APPARATUS

(71) Applicant: SUGINO MACHINE LIMITED, Uozu (JP)

(72) Inventors: Hiroki Haremaki, Uozu (JP); Yoshiteru Kawamori, Itasca, IL (US); Taiki Matsui, Uozu (JP); Kodai Nakazaki, Uozu (JP)

(73) Assignee: SUGINO MACHINE LIMITED, Uozu (JP)

( * ) Notice: Subject to any disclaimer, the term of this patent is extended or adjusted under 35 U.S.C. 154(b) by 161 days.

(21) Appl. No.: 17/329,628

(22) Filed: May 25, 2021

(65) Prior Publication Data

US 2021/0379628 A1 Dec. 9, 2021

(30) Foreign Application Priority Data

Jun. 4, 2020 (JP) ..... 2020-097655
Feb. 15, 2021 (JP) ..... 2021-021993

(51) Int. Cl.

| | |
|---|---|
| ***B08B 3/02*** | (2006.01) |
| ***B08B 13/00*** | (2006.01) |
| *B25B 5/16* | (2006.01) |
| *B08B 3/00* | (2006.01) |

(52) U.S. Cl.

CPC ..... *B08B 3/024* (2013.01); *B08B 13/00* (2013.01); *B08B 3/006* (2013.01); *B25B 5/16* (2013.01)

(58) Field of Classification Search

CPC ..... B08B 13/00; B08B 3/024; B08B 3/006; B25B 5/16

See application file for complete search history.

(56) References Cited

U.S. PATENT DOCUMENTS

2002/0035762 A1* 3/2002 Okuda ..... B08B 3/02 134/102.1
2002/0036006 A1* 3/2002 Ueda ..... H01L 21/6708 134/33
2018/0214916 A1 8/2018 Fukurotani (Continued)

FOREIGN PATENT DOCUMENTS

CN 204817287 U 12/2015
CN 108202069 A 6/2018

(Continued)

OTHER PUBLICATIONS

Extended European Search Report dated Nov. 2, 2021 in a corresponding European Patent Application No. 21173912.3 (9 pages).

*Primary Examiner* — Benjamin L Osterhout
(74) *Attorney, Agent, or Firm* — United IP Counselors, LLC

(57) ABSTRACT

A cleaning apparatus capable of thoroughly cleaning all parts of a workpiece is provided. The cleaning apparatus includes: a cleaning chamber; a table rotation shaft that rotates about a first axis; a first swivel fitting disposed inside the table rotation shaft; a table on which the cleaning workpiece is placed; a first motor that rotates the table rotation shaft; a propeller shaft that rotates about a second axis that is parallel to the first axis; a second swivel fitting connected to a propeller shaft; and a nozzle that rotates integrally with the second swivel shaft and that ejects a cleaning fluid in a direction different from the second axis toward the cleaning workpiece.

11 Claims, 2 Drawing Sheets

(56) References Cited

U.S. PATENT DOCUMENTS

| | | | | |
|---|---|---|---|---|
| 2019/0039203 | A1* | 2/2019 | Toriyabe | B24B 53/017 |
| 2019/0351526 | A1* | 11/2019 | Umemoto | B24B 37/27 |
| 2020/0108424 | A1* | 4/2020 | Kunitomo | B08B 3/022 |
| 2021/0023592 | A1* | 1/2021 | Nakano | B08B 13/00 |

FOREIGN PATENT DOCUMENTS

| | | | |
|---|---|---|---|
| EP | 1250977 | A1 | 10/2002 |
| EP | 1346779 | A2 | 9/2003 |
| EP | 1640077 | A2 | 3/2006 |
| EP | 3156176 | A1 | 4/2017 |
| EP | 3587972 | A1 | 1/2020 |
| EP | 3804867 | A1 | 4/2021 |
| JP | S59-070780 | U | 5/1984 |
| JP | H04-061975 | A | 2/1992 |
| JP | H06-099145 | A | 4/1994 |
| JP | H8-085063 | A | 4/1996 |
| JP | H10-128524 | A | 5/1998 |
| JP | 2001-246342 | A | 9/2001 |
| JP | 2007-214590 | A | 8/2007 |
| JP | 2012-086101 | A | 5/2012 |
| JP | 2016-055275 | A | 4/2016 |
| JP | 2017-056365 | A | 3/2017 |
| JP | 6498892 | B2 | 4/2019 |
| JP | 2019-176551 | A | 10/2019 |
| JP | 2020-037178 | A | 3/2020 |
| KR | 10-2016-0012896 | A | 2/2016 |
| WO | 2018/088102 | A1 | 5/2018 |

* cited by examiner

CLEANING APPARATUS

CROSS-REFERENCE TO RELATED APPLICATIONS

This application claims the benefit of priority to Japanese Patent Application No. 2020-097655, filed on Jun. 4, 2020, and Japanese Patent Application No. 2021-021993, filed on Feb. 15, 2021, the entire contents of which are hereby incorporated by reference.

BACKGROUND

1. Technical Field

The present invention relates to a cleaning apparatus.

2. Description of the Background

A method of cleaning a workpiece by rotating a table to which the workpiece is fixed and spraying a cleaning fluid onto the workpiece from a nozzle installed on the side of the table has been used (for example, Japanese Patent Laid-Open No. 2016-055275).

BRIEF SUMMARY

The conventional cleaning apparatus cannot sufficiently clean the workpiece depending on the shape of the workpiece since the jet of the cleaning fluid does not impinge to every corner of the workpiece.

An object of the present invention is to provide a cleaning apparatus capable of thoroughly cleaning all parts of the workpiece.

A first aspect of the present invention provides a cleaning apparatus, including:

a cleaning chamber;

a table rotation shaft having a hollow shape, the table rotation shaft configured to rotate about a first axis;

a first swivel fitting including a first swivel housing rotatably disposed inside the table rotation shaft, and a first swivel shaft disposed inside the first swivel housing, the first swivel shaft being restricted from rotating;

a table disposed inside the cleaning chamber and fixed to the table rotation shaft, the table on which a cleaning workpiece configured to be placed;

a first motor configured to rotate the table rotation shaft;

a propeller shaft configured to rotate about a second axis that is parallel to the first axis;

a second swivel fitting including a second swivel housing disposed at an end of the propeller shaft inside the cleaning chamber, the second swivel housing being restricted from rotating, and a second swivel shaft disposed inside the second swivel housing, the second swivel shaft configured to rotate integrally with the propeller shaft; and a first nozzle configured to rotate integrally with the second swivel shaft inside the cleaning chamber, the first nozzle configured to eject a first cleaning fluid in a direction different from the second axis toward the cleaning workpiece.

The cleaning includes deburring by air blow and high pressure jet.

The cleaning apparatus includes one or more nozzles. The cleaning apparatus preferably includes a plurality of nozzles. All or part of the nozzles eject cleaning fluid perpendicular to the second axis. The nozzle is, for example, a direct injection nozzle, a flat injection nozzle, and a conical injection nozzle. The nozzles may include a plurality of types of nozzles.

The cleaning fluid is, for example, water, an aqueous cleaning liquid, an organic solvent, compressed air, or dry air. Water is, for example, pure water, ion-exchanged water, tap water, or industrial water. For example, industrial water is filtered to be utilized. The aqueous cleaning liquid is, for example, a neutral cleaning liquid or a basic cleaning liquid. The aqueous cleaning liquid may include a rust inhibitor or a surfactant. The cleaning fluid may be a heated fluid.

The cleaning fluid source may be, for example, a liquid pump, a compressor, or a blower. The cleaning fluid source may be located outside the cleaning apparatus. For example, the cleaning fluid source may be a compressor or a liquid pump installed in a factory.

The first annular flow path is disposed in the first swivel housing or the first swivel shaft.

The second annular flow path is disposed in the second swivel housing or the second swivel shaft.

The first motor and the second motor are disposed outside the cleaning chamber. The first motor or the second motor is, for example, a PM synchronous motor, a servo motor, or a stepping motor. The first motor and the second motor may have a speed reducer. Preferably, the first motor and the second motor have a speed indicator or an angle transducer. The angle transducer is, for example, a rotary encoder or a resolver.

The first motor may be connected to the table rotation shaft by a toothed belt mechanism or a gear mechanism.

The second motor may be directly coupled with the propeller shaft. The propeller shaft may be integral with the output shaft of the second motor. The second motor may be connected to the propeller shaft by a toothed belt mechanism or a gear mechanism.

The working fluid is, for example, compressed air. The working fluid source is, for example, a compressor or a compressed air supply.

The tilting device is, for example, a motor, a rotation cylinder, a combination of an expansion cylinder and a link. The cylinder is, for example, an air cylinder or an electric cylinder. The motor is, for example, a servo motor or a stepping motor.

The linear motion mechanism is, for example, a cylinder, or a ball screw and servomotor mechanism. The cylinder is, for example, an air cylinder, or an electric cylinder. The linear motion mechanism may include a linear motion guide such as a linear guide, a ball spline. The linear guide, the ball screw and the servo motor may be installed in a column disposed on the lower surface of the cleaning chamber 11.

The nozzle, the nozzle holder, the second swivel shaft and the propeller shaft integrally rotate.

Preferably, the nozzle disposed in the main pipe ejects cleaning fluid in a direction perpendicular to the second axis. The nozzle disposed in the branch pipe ejects cleaning fluid in a direction parallel to or inclined to the second axis.

The nozzle holder may be a round tube. The branch pipe branches off from the middle part of the main pipe to be disposed on the basal side of the cleaning workpiece. The branch pipe branches from the distal end portion of the main pipe to be disposed on the distal end side of the cleaning workpiece. The nozzle holder, which includes the main pipe and the branch pipe, may be configured in an L-shape or a C-shape. The nozzle holder may be a prismatic block. A nozzle that ejects on a second ejection plane different from the first ejection plane may be disposed.

The cleaning apparatus according to the present invention is capable of thoroughly cleaning all parts of the workpiece.

DETAILED DESCRIPTION

First Embodiment

Figure 1:
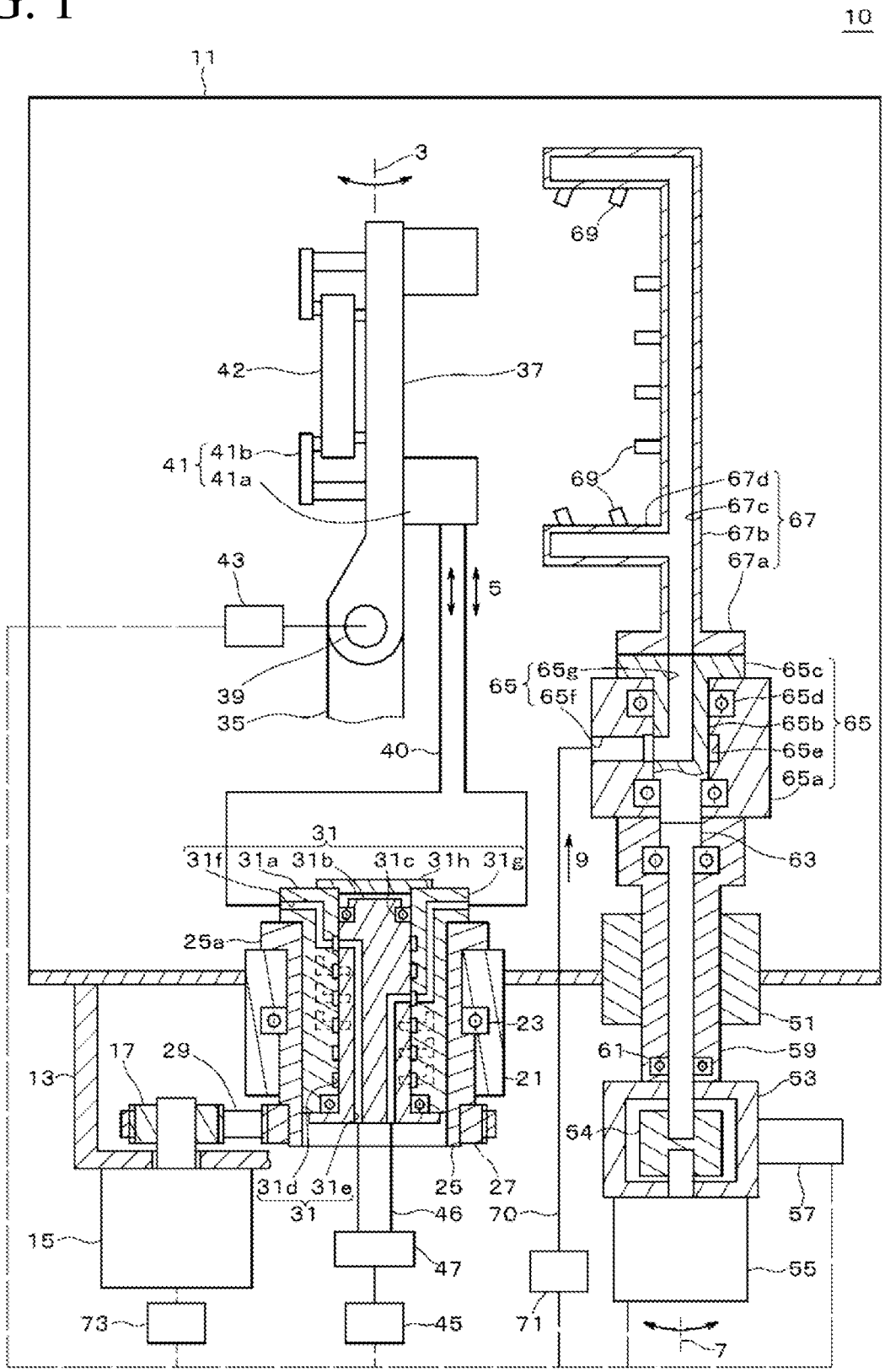
FIG. 1 is a longitudinal sectional view of the cleaning apparatus according to the first embodiment.

FIG. 1 is a cross-sectional view of the cleaning apparatus 10 according to the present embodiment taken along a plane passing through a first axis 3 and a second axis 7. The upward direction in FIG. 1 is vertically upward. As shown in FIG. 1, the cleaning apparatus 10 includes a cleaning chamber 11, a first motor 15, a table rotation shaft 25, a first swivel fitting 31, a table 37, a second motor 55, a propeller shaft 63, a second swivel fitting 65, a first nozzle 69, and a controller 73. The cleaning apparatus 10 may include a motor bracket 13, a driving toothed pulley 17, a driven toothed pulley 27, an endless toothed belt 29, a housing 21, a column 35, a clamping device 41, a working fluid source 45, a valve 47, a linear motion mechanism 57, a motor housing 53, a coupling 54, a slide guide 51, a slide shaft 59, a nozzle holder (first nozzle holder) 67, and a pump (first cleaning fluid source) 71.

The cleaning chamber 11 may have a cylindrical shape having a center at the first axis 3. The first axis 3 and the second axis 7 extends in the vertical direction. The motor bracket 13 is a table-shaped. The motor bracket 13 is disposed outside the cleaning chamber 11 on the lower surface of the cleaning chamber 11.

The first motor 15 is disposed on the motor bracket 13. The first motor 15 is a servo motor.

The housing 21, which has a hollow cylindrical shape having a center along the first axis 3, is disposed through the bottom surface of the cleaning chamber 11. The table rotation shaft 25 is supported inside the housing 21 via a bearing 23. The table rotation shaft 25, which has a hollow cylindrical shape, penetrates the housing 21. The table rotation shaft 25 has a flange 25*a* at the upper end. The flange 25*a* is disposed inside the cleaning chamber 11. A seal ring (not shown) for sealing the gap between the flange 25*a* and the housing 21 may be provided between the flange 25*a* and the housing 21.

The driving toothed pulley 17 is fixed to an output shaft of the first motor 15. The driven toothed pulley 27 is fixed to the lower end of the table rotation shaft 25. The endless toothed belt 29 is tighten between the driving toothed pulley 17 and the driven toothed pulley 27.

The first swivel fitting 31 has a first swivel housing 31*a*, a first swivel shaft 31*b*, a bearing 31*c*, a first flow path 31*e*, a first annular flow path 31*d*, and a second flow path 31*f*. The first swivel fitting 31 may have a flange 31*g*, and a lid 31*h*.

The first swivel housing 31*a*, which has a hollow cylindrical shape, is disposed inside the table rotation shaft 25. The flange 31*g* is disposed on the upper end of the first swivel housing 31*a*. The flange 31*g* is fixed to the flange 25*a*. The first swivel housing 31*a* is integral with the table rotation shaft 25 to rotate about the first axis 3. The first swivel housing 31*a* can be pulled out from above the table rotation shaft 25.

The first swivel shaft 31*b*, which is a solid cylindrical shape, is supported inside the first swivel housing 31*a* via the bearing 31*c*. The rotation of the first swivel shaft 31*b* is restricted. Preferably, the first swivel shaft 31*b* can be pulled out from below the first swivel housing 31*a*.

The lid 31*h*, which is disposed on the upper surface of the first swivel housing 31*a*, closes the inside of the first swivel housing 31*a*.

One or more first annular flow paths 31*d* (a plurality of the first annular flow path 31*d* in FIG. 1) are disposed in the first swivel housing 31*a*.

The first flow path 31*e* is disposed in the first swivel shaft 31*b*. The first flow path 31*e* has one end that is open to the respective first annular flow path 31*d*. The first flow path 31*e* has the other end that is open at the lower end surface of the first swivel shaft 31*b*.

The second flow path 31*f* is disposed in the first swivel housing 31*a*. The second flow path 31*f* has one end that is open to the respective first annular flow path 31*d*. The second flow path 31*f* has the other end that is open to the cylindrical surface of the flange 31*g*.

The column 35, which extends in the vertical direction, is installed on the flange 25*a*. A tilting shaft 39 is disposed at the upper end portion of the column 35.

The table 37 is tiltably supported about the tilting shaft 39. For example, the table 37 is tilted from the vertical direction to the horizontal direction. The table 37 may be freely tilted, or may be positioned only at a specific angle. For example, the table 37 is located at two positions of the horizontal plane and the vertical plane.

The tilting device 43 tilts the table 37. The tilting device 43 includes an air cylinder and a link. The tilting device 43 is capable of positioning the table 37 at two positions.

The column 35, the table 37, and the tilting device 43 rotate integrally with the table rotation shaft 25.

The clamping device 41 includes a fluid cylinder 41*a*, and a clamper 41*b*. The clamping device 41 is disposed on the table 37. The fluid cylinder 41*a* is, for example, a double acting air cylinder. The clamper 41*b* clamps or unclamps the cleaning workpiece 42 according to the expansion or contraction of the fluid cylinder 41*a*. The table 37 rotates about the first axis 3 integrally with the table rotation shaft 25.

The working fluid source 45 is a compressed air supply port. The working fluid 5 is compressed air. The valve 47 is a directional switching valve such as two-position solenoid valve. The valve 47 connects to the working fluid source 45.

The valve 47 and the first flow path 31*e* are connected by a flow path 46. The second flow path 31*f* and the fluid cylinder 41*a* are connected by a flow path 40. The flow paths 40, 46 are, for example, air tubes.

The working fluid 5 is supplied to the fluid cylinder 41*a* and the tilting device 43 through the valve 47, the first swivel fitting 31, the flow path 40, and the flow path 46.

The slide guide 51, which has a hollow columnar shape such as hollow cylinder, is installed to penetrate the bottom surface of the cleaning chamber 11.

The slide shaft 59 is disposed inside the slide guide 51 so as to be retractable along the second axis 7. The outer surface of the slide shaft 59 may slide on the inner surface of the slide guide 51.

The propeller shaft 63 is supported inside the slide shaft 59 via a bearing 61. The propeller shaft 63 rotates about the second axis 7.

The motor housing 53 is disposed at the lower end of the slide shaft 59.

The second motor 55 is disposed on the motor housing 53. The second motor 55 is a servo motor.

A linear motion mechanism 57 is installed on the lower surface of the cleaning chamber 11 to advance or retract the motor housing 53. The linear motion mechanism 57 is a ball screw and servo motor mechanism. The motor housing 53 is disposed on a linear guide (not shown) which is installed parallel to the second axis 7.

The second swivel fitting 65 includes a second swivel housing 65*a*, a second swivel shaft 65*b*, a second annular flow path 65*e*, a third flow path 65*f*, and a fourth flow path 65*g*.

The second swivel housing 65*a*, which is hollow cylindrical, is disposed on the upper end surface of the slide shaft 59.

The second swivel shaft 65*b*, which is cylindrical, is rotatably supported inside the second swivel housing 65*a* via a bearing 65*d*. The second swivel shaft 65*b* rotates integrally with the propeller shaft 63. A flange 65*c* may be disposed at the upper end of the second swivel shaft 65*b*. The second swivel shaft 65*b* may be fixed with the propeller shaft 63 to be constructed as an integral part.

The second annular flow path 65*e* is disposed in the second swivel housing 65*a*.

The third flow path 65*f* is disposed in the second swivel housing 65*a*. The third flow path 65*f* has one end that is open to the second annular flow path 65*e*. The third flow path 65*f* has the other end that is open to the outer cylindrical surface of the second swivel housing 65*a*.

The fourth flow path 65*g*, which is L-shaped, is disposed in the second swivel shaft 65*b*. The fourth flow path 65*g* has one end that is open to the second annular flow path 65*e*. The fourth flow path 65*g* has the other end that is open to the center of the flange 65*c*.

The pump (first cleaning fluid source) 71 is a liquid pump. The liquid pump is, for example, a centrifugal pump or a metering pump. The centrifugal pump is, for example, a turbine pump. The metering pump is, for example, a piston pump. For example, the pump 71 has a discharge pressure of 1 MPa to 50 MPa. The cleaning fluid (first cleaning fluid) 9 is, for example, pure water or a water-soluble cleaning liquid.

The nozzle holder 67 rotates about the second axis 7 integrally with the second swivel shaft 65*b*. The nozzle holder 67 includes a flange 67*a*, a main pipe 67*b*, a flow path 67*c*, and branch pipes 67*d*. The flange 67*a* is joined to the flange 65*c*. The main pipe 67*b* extends along the second axis 7. The branch pipes 67*d* extend perpendicularly to the main pipe 67*b* from the middle and the distal end of the main pipe 67*b*. The branch pipes 67*d* are disposed so as to surround the upper and lower portions of the cleaning workpiece 42. The nozzle holder 67, which is C-shaped as a whole, surrounds the half of one side of the cleaning workpiece 42. The main pipe 67*b* and the branch pipes 67*d* are round pipes. The flow path 67*c* is a space inside the main pipe 67*b* and the branch pipes 67*d*. The flow path 67*c* is connected to the fourth flow path 65*g*. Preferably, the flow path 67*c* has the same cross-sectional area as the fourth flow path 65*g*.

The nozzle 69, which is disposed on the nozzle holder 67 so as to face the cleaning workpiece 42, is connected to the flow path 67*c*. For example, a plurality of nozzles 69 are disposed along the nozzle holder 67 on a single ejection plane passing through the second axis 7. At this time, the nozzle 69 ejects the cleaning fluid 9 along the ejection plane. Some nozzles 69 may eject cleaning fluid 9 perpendicular to the second axis 7.

The controller 73 controls the first motor 15, the second motor 55, the valve 47, the pump 71, the tilting device 43, and the linear motion mechanism 57. The controller 73 is, for example, a microcomputer, a sequencer, or a numerical controller.

According to the cleaning apparatus 10, the cleaning workpiece 42 can be freely rotated or swung about the first axis 3. Further, the nozzle 69 can be freely rotated or swung about the second axis 7. For example, the cleaning apparatus 10 rotates the cleaning workpiece 42 and swings the nozzle 69 in synchronization with the rotation phase of the cleaning workpiece 42. By freely swinging the nozzle 69 about the second axis 7 with changing the rotational phase of the cleaning workpiece 42, the cleaning fluid 9 impinges on the cleaning workpiece 42 at various angles.

Since the nozzle holder 67 has the branch pipes 67*d* so as to surround the cleaning workpiece 42, the upper and lower surfaces of the cleaning workpiece 42 can also be cleaned.

The posture of the cleaning workpiece 42 can be changed by the tilting device 43. The tilting device 43 changes the collision position and the collision angle of the cleaning fluid 9 to the cleaning workpiece 42 by changing the posture of the cleaning workpiece 42 during cleaning. The tilting device 43 may stand the table 37 during cleaning, and tilts the table 37 horizontally after completion of cleaning. When the table 37 is cleaned with standing posture, the distance between the cleaning workpiece 42 and the nozzle 69 can be short. When the table 37 is horizontal, the cleaning workpiece 42 can be stably placed on the table 37. Therefore, it is convenient to install and carry out the cleaning workpiece 42.

The table rotation shaft 25 and the propeller shaft 63 may be installed extending downward from the upper surface of the cleaning chamber 11.

Second Embodiment

Figure 2:
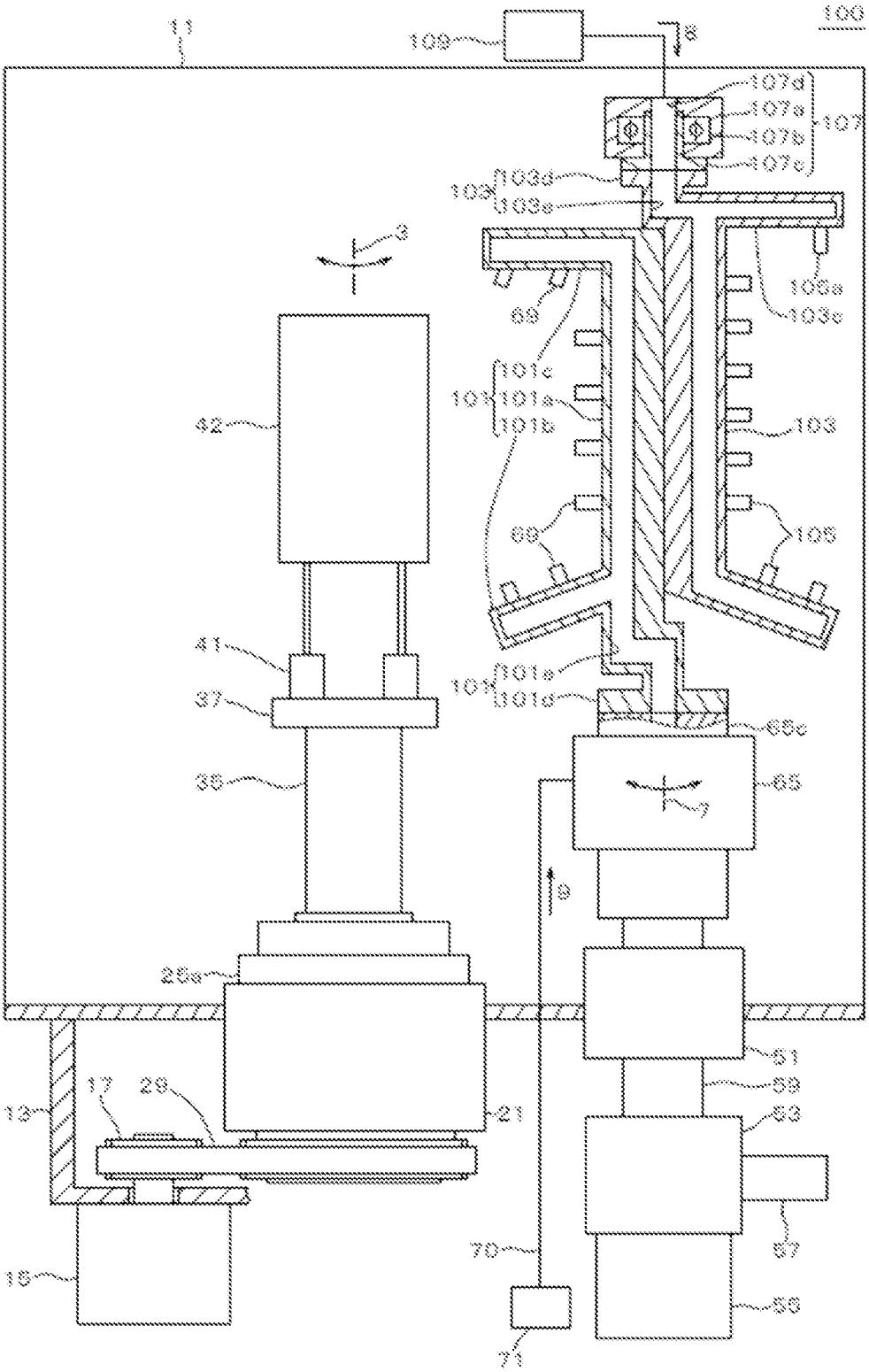
FIG. 2 is a longitudinal sectional view of the cleaning apparatus according to the second embodiment.

FIG. 2 is a cross-sectional view taken in a plane passing through the first axis 3 and the second axis 7 of a cleaning apparatus 100 according to the present embodiment. The cleaning apparatus 100 includes a first nozzle block 101, a second nozzle block 103, a second nozzle 105, a third swivel fitting 107, and a second fluid source 109. The second nozzle 105 ejects a second fluid 8. The other configuration of the cleaning apparatus 100 of the present embodiment is substantially the same as that of the cleaning apparatus 10 of the first embodiment.

The first nozzle block 101 includes a main block 101*a*, a lower block 101*b*, an upper block 101*c*, a flange 101*d*, and a flow path 101*e*. The main block 101*a*, which has a rectangular parallelepiped shape, extends vertically. The lower block 101*b* extends obliquely downward from a lower portion of the main block 101*a* toward the first axis 3. The upper block 101*c* extends horizontally from an upper portion of the main block 101*a* toward the first axis 3. The flange 101*d*, which is disposed at the lower end of the main block 101*a*, is fastened to the flange 65*c*. The nozzles 69 are arranged on the ejection plane passing through the second axis 7 in the main block 101*a*, the lower block 101*b* and the upper block 101*c*. The nozzles 69 are disposed toward the cleaning workpiece 42. The flow path 101*e* is disposed inside the main block 101*a*, the lower block 101*b*, and the upper block 101*c*. The flow path 101*e* connects the fourth flow path 65*g* and the nozzle 69.

The second nozzle block 103 has substantially the same structure as the first nozzle block 101. The second nozzle block 103 is disposed rotationally symmetrically to the first nozzle block 101 with respect to the second axis 7. For example, the second nozzle block 103 is disposed at a position rotated 180 degrees on the back of the first nozzle block 101. The second nozzle block 103 includes an upper block 103*c*, a flange 103*d*, and a flow path 103*e*. The flange 103*d* is disposed at the upper end of the second nozzle block 103 with the center located at the second axis 7. The flow path 103*e* connects the flange 103*d* and the second nozzle 105.

The second nozzle 105 is arranged on the second nozzle block 103 and on a second ejection plane passing through the second axis 7. The second nozzle 105 may include a nozzle 105*a* which is disposed at the distal end portion of the upper block 103*c* and ejects the second fluid 8 vertically downward.

A third swivel fitting 107 is disposed above the second nozzle block 103 having the center at the second axis 7. The third swivel joint 107 includes a third swivel housing 107*a*, a third swivel shaft 107*c*, a bearing 107*b*, and a fifth flow path 107*d*. The third swivel housing 107*a* may be fixed to the cleaning chamber 11. The third swivel shaft 107*c* is supported by the third swivel housing 107*a* via a bearing 107*b* so as to be rotatable about the second axis 7. The fifth flow path 107*d* passes through the third swivel housing 107*a* and the third swivel shaft 107*c* having the center at the second axis 7. The fifth flow path 107*d* is connected to the flow path 103*e*.

The second fluid source 109 may be, for example, an air compressor, a blower, or an air inlet. The second fluid source 109 is connected to the fifth flow path 107*d*. The second fluid source 109 feeds the second fluid 8 to the second nozzle 105 via the fifth flow path 107*d* and the flow path 103*e*. The second fluid 8 is, for example, air, heated air, compressed air, dry air, or steam.

According to the cleaning apparatus 100 of the present embodiment, when the first nozzle block 101 is directed toward the cleaning workpiece 42, the nozzle 69 ejects the cleaning fluid 9 onto the ejection plane to clean the cleaning workpiece 42. Further, by rotating the nozzle blocks 101, 103 around the second axis 7, the second nozzle block 103 is directed to the cleaning workpiece 42. When the second nozzle block 103 is directed toward the cleaning workpiece 42, the second nozzle 105 ejects the second fluid 8 onto the second ejection plane. For example, the cleaning workpiece 42 is cleaned by the cleaning fluid 9 which is a cleaning liquid, and then the cleaning workpiece 42 is dried by the second fluid 8 which is dry air.

The first nozzle 69 is disposed on the first nozzle block 101. The second nozzle 105 is disposed on the second nozzle block 103. Thus, the first nozzle 69 and the second nozzle 105 are disposed on the ejection plane passing through the second axis 7 to eject fluid on the ejection plane. In operation of the cleaning apparatus 100, the rotation phase of the first nozzle 69, the second nozzle 105, and the table 37 is required to be synchronized. Since the first nozzle 69 and the second nozzle 105 are disposed on the ejection plane passing through the second axis 7, the rotation phase of the first nozzle 69, the second nozzle 105, and the table 37 is easily controlled.

In the present embodiment, the cleaning fluid 9 passes through the second swivel fitting 65. The second fluid 8 passes through the third swivel fitting 107. By using swivel fittings 65, 107 for each fluid, an effective cross-sectional area of the flow path is easily become large. Thus, even when the volume of the cleaning chamber 11 is relatively small, the flow rates of the cleaning fluid 9 and the second fluid 8 are easily increased.

The cleaning apparatus 100 of the present embodiment includes two nozzle blocks, but may include three or more nozzle blocks. For example, when the cleaning apparatus 100 includes three nozzle blocks, each nozzle block may be arranged by shifting 120 degrees when viewed along the second axis 7. The number and shape of the nozzle block may be appropriately changed according to the type of fluid and the flow rate of the fluid.

The present invention is not limited to the embodiments described above, and various modifications can be made without departing from the gist of the present invention, and all technical matters included in the technical idea described in the claims are the subject matter of the present invention. While the foregoing embodiments illustrate preferred examples, those skilled in the art will appreciate that various alternatives, modifications, variations, or improvements may be made in light of the teachings disclosed herein and are within the scope of the appended claims.

REFERENCE SIGNS LIST

3 First axis
5 Working fluid
7 Second axis
9 Cleaning fluid
10 Cleaning apparatus
11 Cleaning chamber
15 First motor
25 Table rotation shaft
31 First swivel fitting
31*a* First swivel housing
31*b* First swivel shaft
37 Table
42 Cleaning workpiece
45 Working fluid source
55 Second motor
63 Propeller shaft
65 Second swivel fitting
65*a* Second swivel housing
65*b* Second swivel shaft
67 Nozzle holder
69 Nozzle
71 Pump (cleaning fluid source)

What is claimed is:

1. A cleaning apparatus, comprising:
a cleaning chamber;
a table rotation shaft having a hollow shape, the table rotation shaft configured to rotate about a first axis;
a first swivel fitting including
a first swivel housing rotatably disposed inside the table rotation shaft, and
a first swivel shaft disposed inside the first swivel housing, the first swivel shaft being restricted from rotating;
a table disposed inside the cleaning chamber and fixed to the table rotation shaft, the table on which a cleaning workpiece is configured to be placed;
a first motor configured to rotate the table rotation shaft;
a propeller shaft configured to rotate about a second axis that is parallel to the first axis;
a second swivel fitting including
a second swivel housing disposed at an end of the propeller shaft inside the cleaning chamber, the second swivel housing being restricted from rotating, and
a second swivel shaft disposed inside the second swivel housing, the second swivel shaft configured to rotate integrally with the propeller shaft; and a first nozzle configured to rotate integrally with the second swivel shaft inside the cleaning chamber, the first nozzle configured to eject a first, cleaning fluid in a direction different from the second axis toward the cleaning workpiece, a clamping device including a fluid cylinder, the clamping device disposed on the table;

a first, cleaning-fluid source;

a second, working-fluid source; and a valve connected to the second, working-fluid source;

wherein the first swivel fitting includes a first annular flow path disposed between the first swivel housing and the first swivel shaft, a first flow path connecting the first annular flow path and the valve, the first flow path disposed in the first swivel shaft, and a second flow path connecting the first annular flow path and the fluid cylinder, the second flow path disposed in the first swivel housing, the second swivel fitting includes a second annular flow path disposed between the second swivel housing and the second swivel shaft, a third flow path connecting the second annular flow path and the first, cleaning-fluid source, the third flow path disposed in the second swivel housing, and a fourth flow path connecting the second annular flow path and the first nozzle, the fourth flow path disposed in the second swivel shaft.

2. The cleaning apparatus according to claim 1, wherein the first axis extends vertically.

3. The cleaning apparatus according to claim 1, wherein the table rotation shaft is disposed to pass through the cleaning chamber, the table rotation shaft includes a flange disposed inside the cleaning chamber, and the first swivel housing is fixed to the flange and capable of being pulled out inside the cleaning chamber.

4. The cleaning apparatus according to claim 1, further comprising:

a column fixed to the table rotation shaft, the column configured to support the table;

a tilting device disposed to the column;

wherein the table is pivotally disposed on the column, and the tilting device changes a posture of the table.

5. The cleaning apparatus according to claim 1, further comprising:

a first nozzle holder fastened to the second swivel shaft;

wherein the first nozzle is disposed on the first nozzle holder so as to eject the first cleaning fluid along a first ejection plane passing through the second axis.

6. The cleaning apparatus according to claim 5, wherein the first nozzle holder includes a main pipe extending along the second axis, and a branch pipe branching from the main pipe, the branch pipe extending along the ejection plane, and a plurality of the first nozzles are disposed on the main pipe and the branch pipe.

7. The cleaning apparatus according to claim 5, further comprising:

a third fluid source;

a third swivel fitting disposed on the first nozzle holder at the opposite side to the second swivel fitting, the third swivel fitting including a third swivel housing, and a third swivel shaft rotatably supported by the third swivel housing about the second axis; and a second nozzle configured to rotate integrally with the third swivel shaft inside the cleaning chamber, the second nozzle configured to eject a third fluid in a direction different from the second axis toward the cleaning workpiece.

8. The cleaning apparatus according to claim 7, further comprising:

a second nozzle holder fastened to the third swivel shaft;

wherein the second nozzle is disposed on the second nozzle holder so as to eject the third fluid along a second ejection plane passing through the second axis.

9. The cleaning apparatus according to claim 7, further comprising:

a slide guide disposed along the second axis;

a slide shaft configured to slidably advance or retract along the second axis on the slide guide, the slide shaft configured to rotatably support the propeller shaft; and a linear motion mechanism configured to advance or retract the slide shaft.

10. The cleaning apparatus according to claim 9, wherein the slide shaft is disposed to pass through the cleaning chamber, and the second swivel fitting is disposed inside the cleaning chamber.

11. The cleaning apparatus according to claim 9, wherein the first axis extends vertically.

* * * * *